US007097088B2

(12) United States Patent
Shor

(10) Patent No.: US 7,097,088 B2
(45) Date of Patent: Aug. 29, 2006

(54) FORWARD ACTING STAPLER WITH UNIQUE LINKAGE

(75) Inventor: Ilya Shor, Brooklyn, NY (US)

(73) Assignee: Arrow Fastener Co., Inc., Saddlebrook, NJ (US)

( * ) Notice: Subject to any disclaimer, the term of this patent is extended or adjusted under 35 U.S.C. 154(b) by 0 days.

(21) Appl. No.: 10/889,726

(22) Filed: Jul. 13, 2004

(65) Prior Publication Data

US 2004/0238592 A1 Dec. 2, 2004

Related U.S. Application Data

(63) Continuation of application No. 10/285,719, filed on Nov. 1, 2002, now Pat. No. 6,789,719.

(51) Int. Cl.
*B25C 1/02* (2006.01)

(52) U.S. Cl. ..... 227/132; 227/120; 227/134

(58) Field of Classification Search ..... 227/132, 227/134, 120
See application file for complete search history.

(56) References Cited

U.S. PATENT DOCUMENTS 1,830,650 A * 11/1931 Falk ..... 227/124
2,326,540 A 8/1943 Krantz
2,361,483 A * 10/1944 Lang ..... 227/132
2,492,509 A * 12/1949 Vandervieren ..... 227/132
2,493,640 A * 1/1950 Peterson ..... 227/132
2,659,083 A * 11/1953 Boroughs ..... 227/132
2,769,174 A 11/1956 Libert
2,884,636 A * 5/1959 Abrams ..... 227/132
3,229,882 A * 1/1966 Abrams ..... 227/132
3,913,817 A 10/1975 Barrett
4,629,108 A 12/1986 Judge
5,009,356 A 4/1991 Chang
5,165,587 A 11/1992 Marks
5,232,142 A * 8/1993 Reichert et al. ..... 227/134
5,328,075 A 7/1994 Marks
5,335,839 A 8/1994 Fealey
5,407,118 A 4/1995 Marks
5,427,299 A 6/1995 Marks
D360,566 S 7/1995 Marks
5,497,932 A 3/1996 Brewer
5,505,362 A 4/1996 Marks
5,511,716 A 4/1996 Marks
D384,257 S 9/1997 Marks
D384,258 S 9/1997 Marks
5,664,722 A 9/1997 Marks
5,699,949 A 12/1997 Marks
5,765,742 A 6/1998 Marks
5,816,470 A 10/1998 Plato
5,979,736 A 11/1999 Edeholt
5,988,478 A 11/1999 Marks
6,131,788 A 10/2000 Marks
6,145,728 A 11/2000 Marks
6,355,892 B1 3/2002 Marks
6,789,719 B1 * 9/2004 Shor ..... 227/132

FOREIGN PATENT DOCUMENTS

DE 31 26 536 A1 1/1983

* cited by examiner

*Primary Examiner*—Scott A. Smith
(74) *Attorney, Agent, or Firm*—Carlson, Gaskey & Olds

(57) ABSTRACT

A forward acting stapler includes a unique linkage for driving a firing lever. The linkage includes two links that are each connected to the trigger lever by a roller. The roller is movable within a spot in the trigger lever. As the handle is driven, the two links cause the triggering level to pivot. As the trigger lever pivots it lifts a plunger against a spring force. At some point, the trigger portion releases the plunger allowing the plunger to be returned by the spring force by a staple.

14 Claims, 5 Drawing Sheets

FORWARD ACTING STAPLER WITH UNIQUE LINKAGE

This application is a continuation of Ser. No. 10/285,719 filed on Nov. 1, 2002 now U.S. Pat. No. 6,789,719.

BACKGROUND OF THE INVENTION

This invention relates to a forward acting stapler.

Forward acting staplers are known in the art, and have a handle which is pivoted at one end of a stapler body. The handle is pivoted downwardly with the hand of the user received on an end of the handle remote from the pivot point. This end is generally vertically spaced above the location where a plunger and knife combination will drive a staple or nail into a workpiece. For purposes of this application, the term "plunger" should be understood to also include the knife which moves with the plunger. The forward acting stapler is an improvement over staplers which have the pivot point of the handle on the end of a stapler body which receives the plunger in that the force of the hand can be applied more directly to the plunger.

In the prior art, such forward acting staplers have been known for decades. However, the forward acting staplers known to date have had complex linkages which have made them difficult to use and sometimes unreliable.

SUMMARY OF THE INVENTION

The present invention provides a linkage including a handle lever which is connected by a pair of links to a trigger lever. In fact, each of the links have two sides which are positioned on each side of the handle lever in a preferred embodiment. The trigger lever is controlled to pivot as the firing handle is pivoted downwardly. The trigger lever has a trigger portion adjacent the end of the housing which receives the firing plunger. The two-part linkage between the handle lever and the trigger lever includes a first link pinned to the handle lever and which moves a roller. The roller is also fixed to a holding link which is pivotally attached to the housing. The roller is received in a slot in the trigger lever. The arrangement of the two links, the handle lever, and the trigger lever slot is such that as the handle lever is moved downwardly, the first link forces the roller to move in a direction to pivot the trigger lever in such a way that the trigger portion at the end of the trigger lever moves in a direction upwardly. When this movement occurs, the holding link causes the roller to move within the slot in a direction away from a pivot point of the trigger lever. The trigger portion of the trigger lever includes a member which is spring biased to a holding position at which it is received under a ledge on an actuating plunger. A flat power spring extends through the body of the stapler and biases the plunger to drive a staple or nail into a work surface once the plunger is released by the trigger lever.

As the handle is moved downwardly, the movement between the two links and the two levers continues with the trigger portion of the trigger lever continuing to pull the plunger upwardly against the force of the spring. During this movement, the geometry of the trigger portion tends to move the trigger away from the plunger. At some point, the power spring drives the plunger to drive a staple into the workpiece.

In a preferred embodiment, the trigger portion is mounted near the end of the trigger lever on a pair of pins and a bias spring combination. One pin is fixed to the trigger lever and is received within a slot in the trigger portion. The trigger portion has its own pin received in a slot on the trigger lever. A spring biases the trigger portion pin toward the trigger lever pin, and thus biases the trigger portion outwardly toward the plunger. This spring force holds the trigger portion under the plunger as the plunger is raised, and up until the firing point. When the trigger lever is returned after firing, this spring allows the trigger portion to cam along a ramp surface on the plunger and be returned beneath the plunger ledge.

The present invention provides a reliable and simplified linkage. Further, the trigger portion is also simple and yet quite reliable.

The present invention can be best understood from the following specification and drawings, the following of which is a brief description.

DETAILED DESCRIPTION OF THE PREFERRED EMBODIMENT

Figure 1:
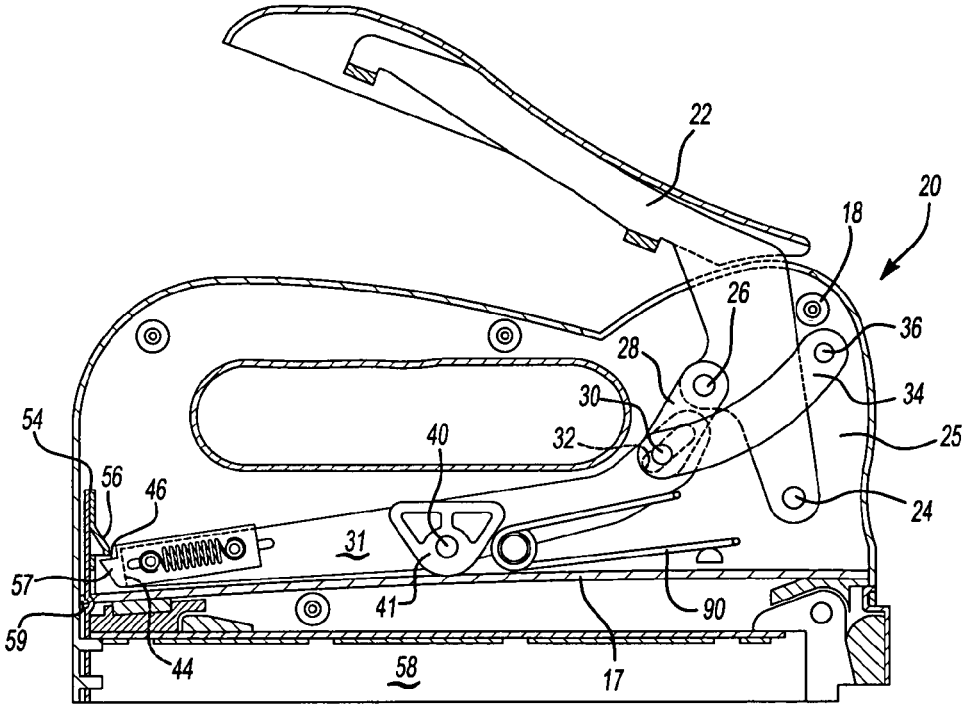
FIG. 1 shows a stapler in a relaxed position.

FIG. 1 shows a forward acting stapler 20. As shown, handle lever 22 is pivotally attached at pivot point 24 within a stapler housing 25. A pin creates a pivot point 26 pivotally connects a first link 28 to the handle lever 22. A roller 30 moves with the link 28, and is received in a slot 32 in a trigger lever 31. A holding link 34 also moves with the roller 30 and is pivotally attached at pivot point 36 to the stapler housing 25. Notably, the pivot point 36 and the pivot point 26 are on opposed sides of the handle lever 22, and on opposed sides of the pivot point 24. Also, notably, in this figure, the roller 30 is spaced toward the left hand side of the forward acting stapler 20 from pivot points 26, 24 or 36. The trigger lever 31 is pivotally connected at 40 to the housing by a structure having a surface 41 in contact with an upper surface of an elongate power spring 17. A trigger portion 46 of the trigger lever 31 extends forwardly of the nominal end 44 of the trigger lever 31. The trigger portion is mounted on the trigger lever with a pin/spring arrangement that will be described below.

A plunger 54 includes a plunger ledge 56 that is generally aligned with a forward portion 57 of the trigger portion 46. A magazine 58 indexes staples or nails to a position under the plunger, such that the plunger can drive the staple or nail into a work surface. A forward end 59 of the elongate power spring 17 is also received in the plunger.

The return spring 90 holds the handle lever 22 against a handle stop 18 in this position.

Generally, as the handle lever 22 is pivoted downwardly it causes the trigger lever 31 to pivot clockwise as shown in this figure. As this occurs, the forward portion 57 lifts the plunger 54 through the plunger ledge 56 and against the force of the elongate power spring 17. The forward portion 57 continues to lift the plunger 54 to a point at which the plunger 54 becomes disengaged from the trigger portion.

Figure 2:
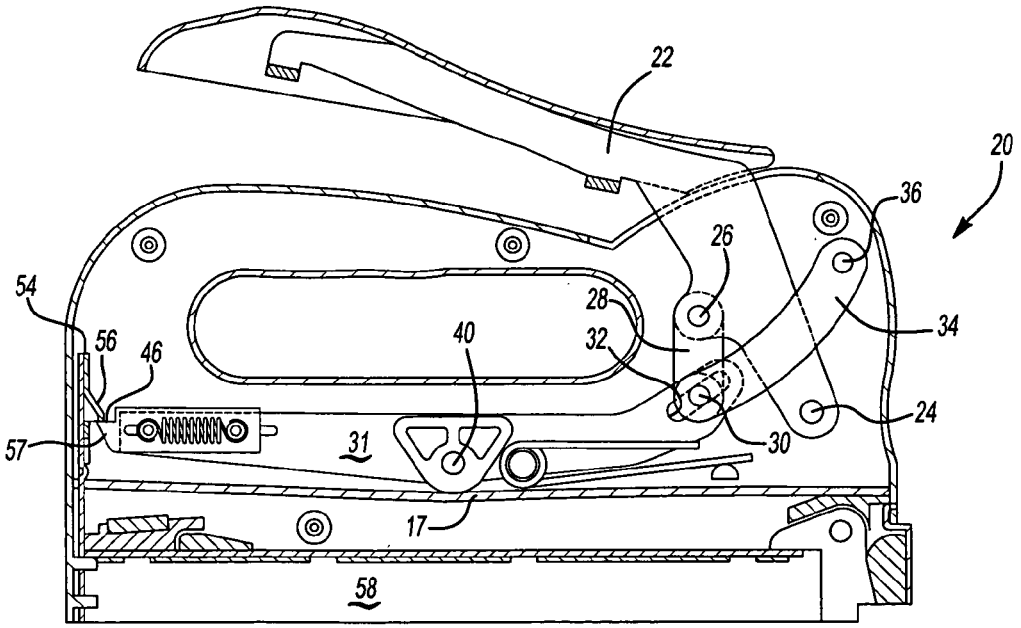
FIG. 2 shows a point during the initial movement of the stapler towards a firing position.

As shown in FIG. 2, as the handle lever 22 begins to be pivoted about pivot point 24 and counterclockwise as shown in this figure, the connection of the handle lever 22 to pivot point 26 also drives the links 28 and 34 in a similar direction. As this movement occurs, the roller 30 moves within the slot 32. However, with such movement the link 34 begins to constrain the roller 30 to move downwardly and to the right as shown in this figure that increases the distance between pivot point 40 and roller 30 (see FIGS. 5B and 5C). When this occurs, the trigger lever 31 also begins to pivot about its pivot point 40, downwardly with the roller 30. As this occurs, and as can be seen in the left side of FIG. 2, the forward portion 57 begins to lift the plunger ledge 56, lifting the plunger 54. As is clear from this figure, the elongate power spring 57 begins to flex, and urge the plunger in an opposed direction.

Figure 3:
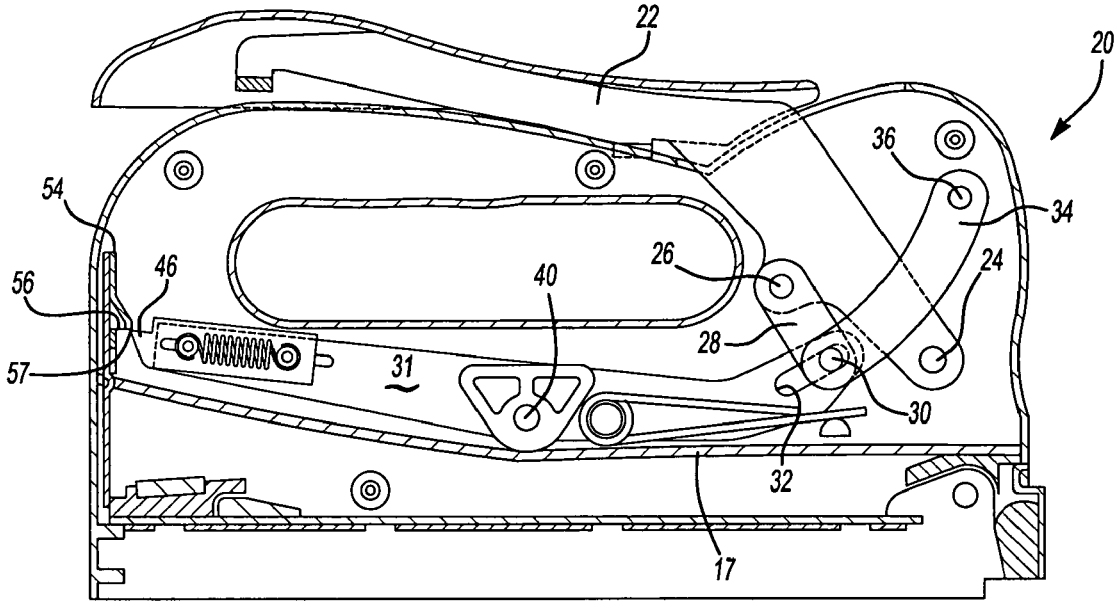
FIG. 3 shows a point subsequent to the FIG. 2 point.

As the handle lever 22 continues to pivot as shown in FIG. 3, the trigger portion 46 eventually begins to move away from the plunger ledge 56. At the point shown in FIG. 3, the linkage is about to fire the plunger.

Figure 4:
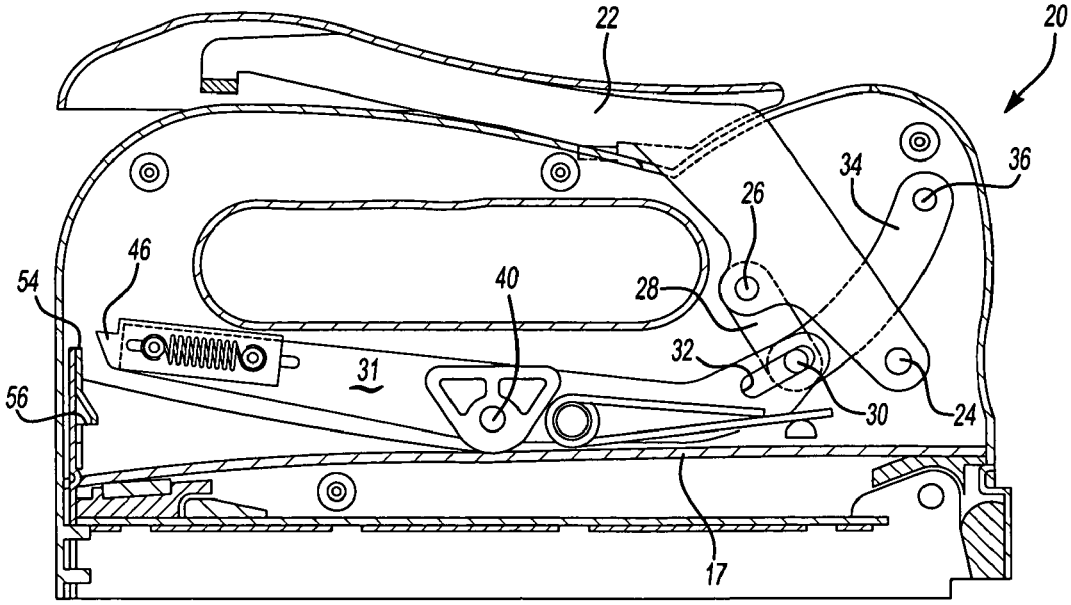
FIG. 4 shows yet another subsequent point.

As shown in FIG. 4, the trigger portion 46 of the trigger has now allowed the plunger ledge 56 to move past. The elongate power spring 57 then fires the plunger 54 back downwardly. With this movement a staple or nail is driven into a workpiece, as known.

Figure 5A:
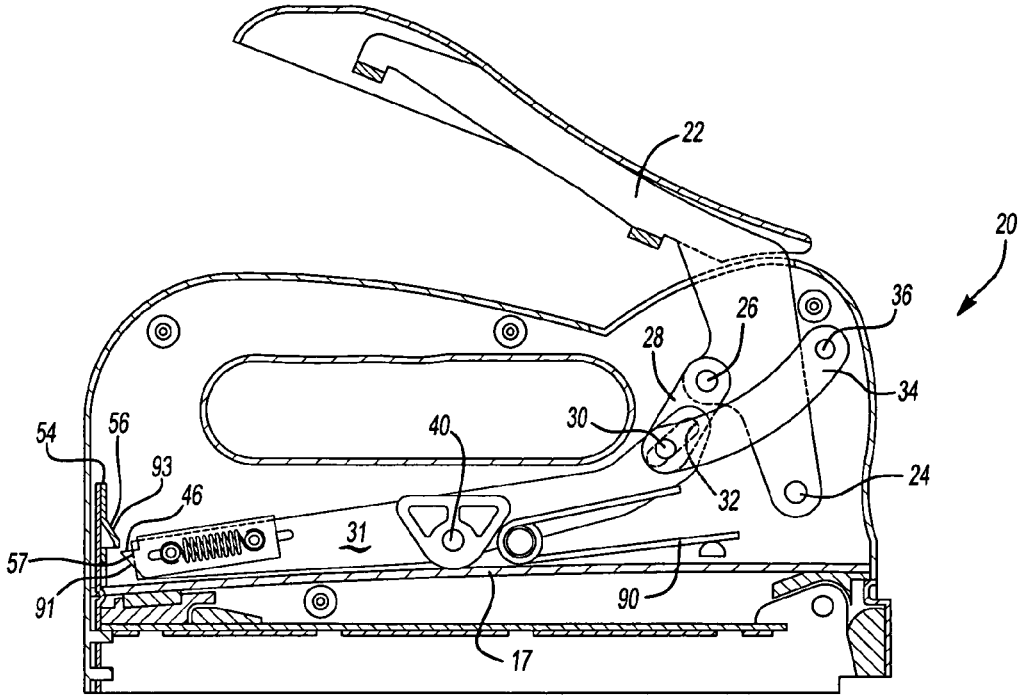
FIG. 5A shows yet another subsequent point.

As shown in FIG. 5A, the staple has now been fired. A return spring 90 now provides a return force driving the linkages back to the FIG. 1 position. As shown in FIG. 5, the trigger portion 46 of the trigger lever 31 has moved past the top of the plunger ledge 56. During this movement, a ramped surface 91 underneath the forward portion 57 and a ramped surface 93 above the plunger ledge will allow the forward portion to move further to the right until eventually it can move beyond the plunger ledge 56. At this point, the system will return to the position as shown in FIG. 1.

Figure 5B:
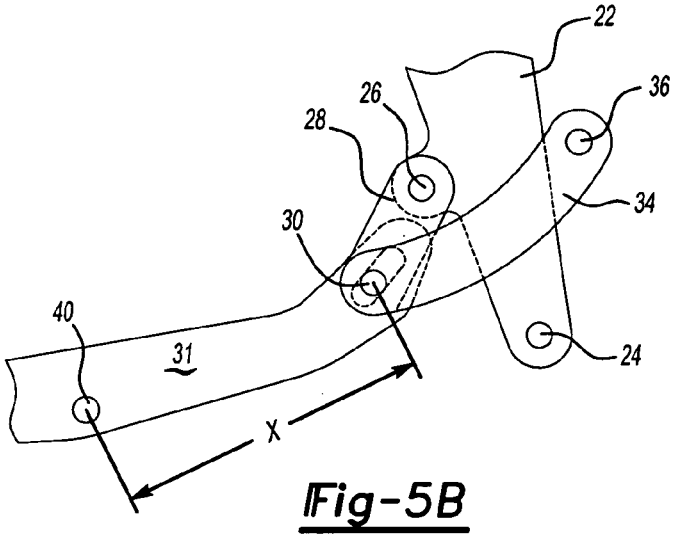
FIG. 5B shows the position of the linkages and roller at the beginning of movement.
Figure 5C:
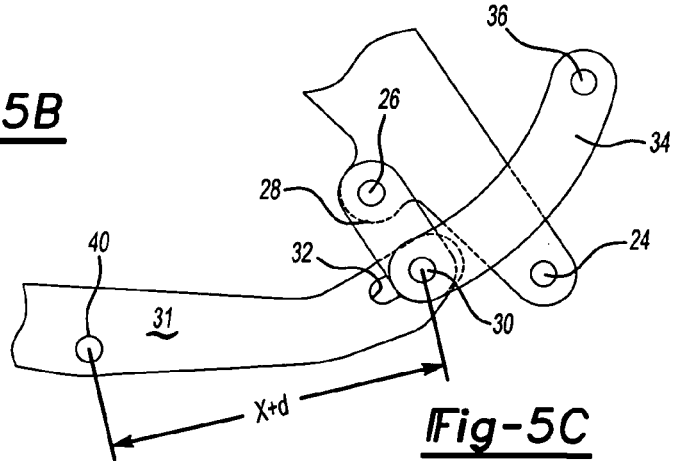
FIG. 5C shows a point subsequent to the FIG. 5A point, and in particular the firing point.

As shown in FIGS. 5B and 5C, the distance between pivot point 40 and the roller 30 will change between the rest position and the firing point. As shown, if the distance between the two at rest (FIG. 5B) is X, then at the firing point (FIG. 5C) the distance is X+d. This change in distance controls movement as set forth above.

Figure 5D:
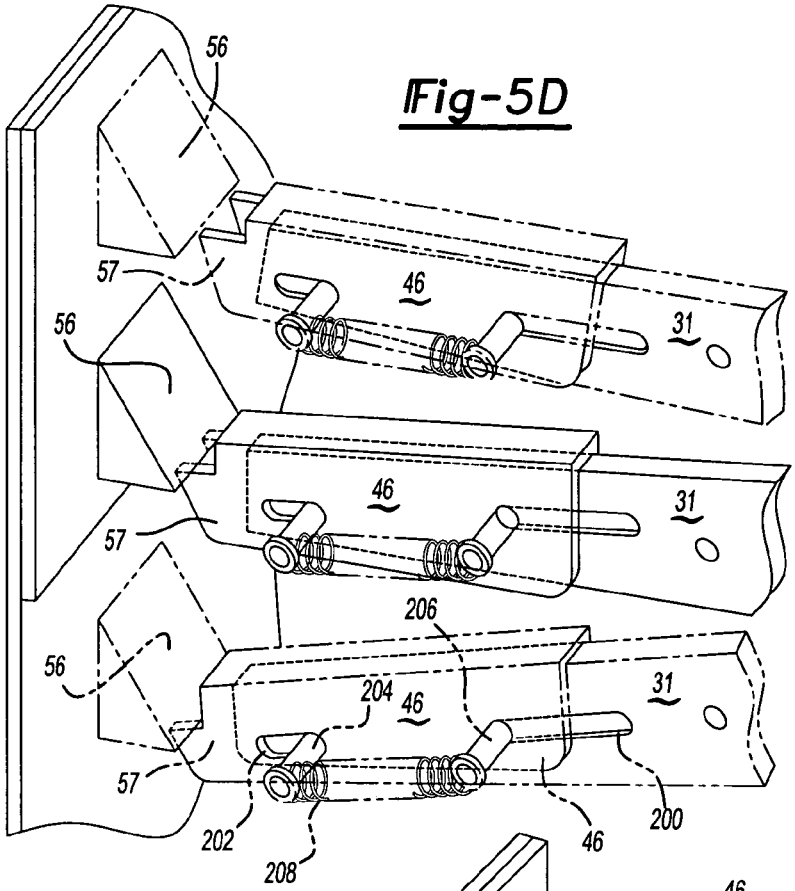
FIG. 5D shows the structure and movement of the trigger portion as it moves toward the firing point.
Figure 5E:
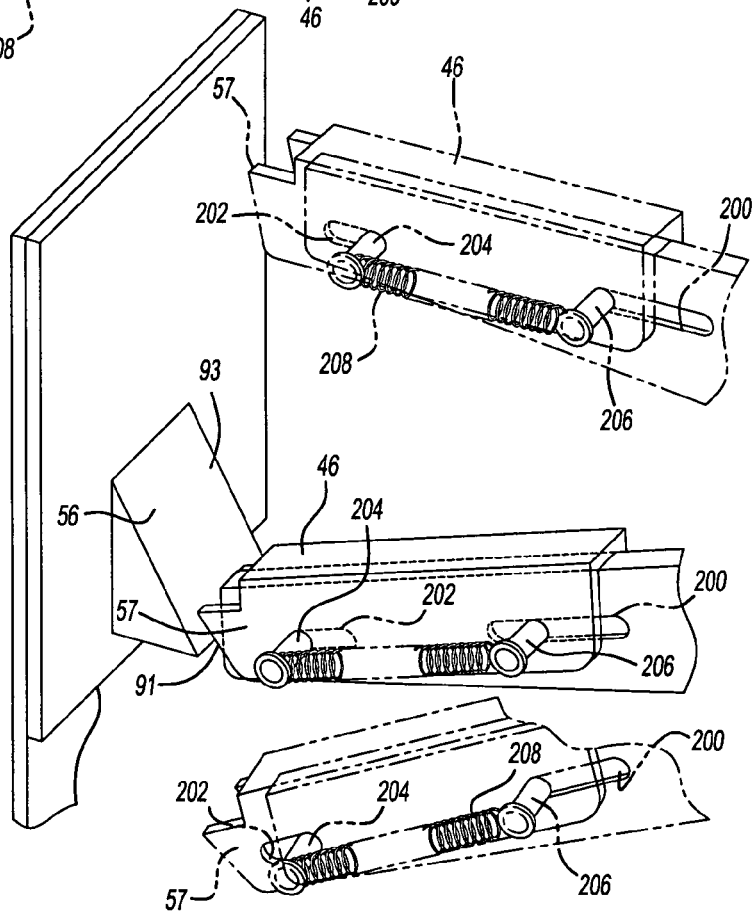
FIG. 5E shows the structure and movement of the trigger portion as it is returned to its original rest position.

Further details of the trigger portion and trigger lever are shown in FIGS. 5D and 5E. FIG. 5D shows the movement as the trigger lever 31 is being driven to lift the plunger. As shown, the forward portion 57 of the trigger lever 31 is retained beneath the plunger ledge 56. A pin 204 attached to the trigger lever 31 is movable within a slot 202 in the trigger portion 46. A pin 206 is fixed to the trigger portion 46 and is movable within a slot 200 in the trigger lever. A spring 208 biases the pin 206 toward to the pin 204, thus drawing the trigger portion 46 to the left as shown in this figure and beneath the plunger ledge 56. As can be seen, the trigger portion 46 spans both sides of the trigger lever 31. Thus, both pins 204 and 206 preferably extend through the trigger lever 31 and are received in both sides of the trigger portion 46.

The two pin and spring combination serves to allow the trigger portion to return to the rest position once the staple or nail has been fired. FIG. 5E shows the movement back to the FIG. 5A position. As shown in FIG. 5E, the ramped surface 91 cams along the ramped surface 93 of the plunger ledge 56. During this movement, the trigger portion 46 is forced to the right. Pin 206 can move within the slot 200, while the pin 204 moves within the slot 202. As shown in the intermediate position in FIG. 5E, this movement guides the trigger portion as it moves along the ramp surface 93. Once the forwardmost portion 57 of the trigger portion 46 is moved beyond the plunger ledge 56, the spring 208 returns the trigger portion 46 back to the left, such that it can again reach its rest position.

Figure 6A:
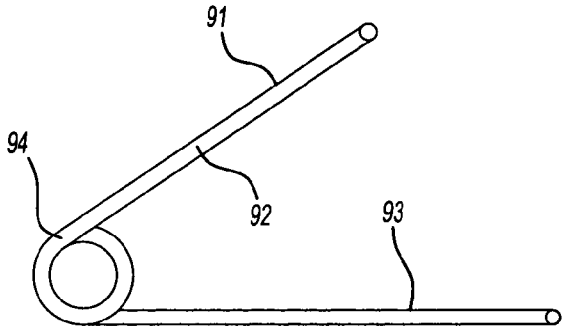
FIG. 6A shows a first view of a return spring.

As shown in FIG. 6A, the return spring 191 includes a first leg 192 and a second leg 193. In all positions shown within FIGS. 1–5, the return spring is biased away from this relaxed position.

Figure 6B:
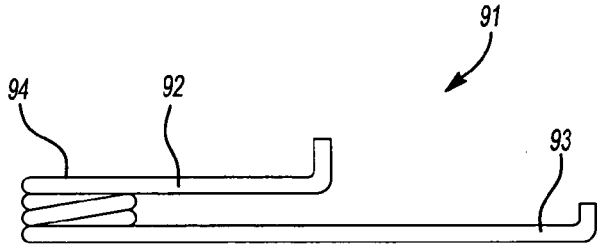
FIG. 6B shows a second view of the return spring.

FIG. 6B shows a top view of the return spring 91.

Figure 7:
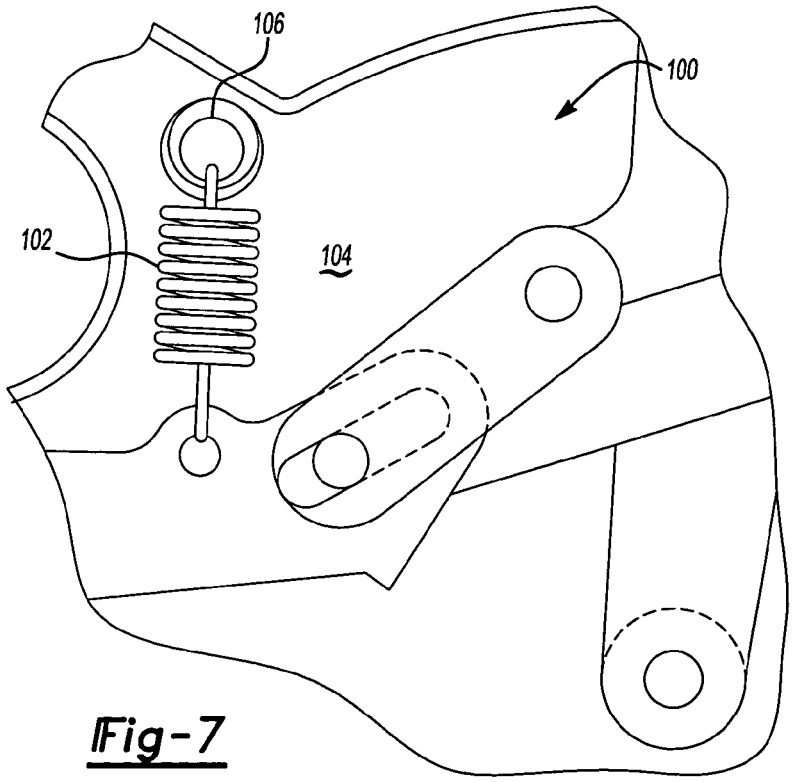
FIG. 7 shows an alternate embodiment.

FIG. 7 shows an alternative embodiment in which the return spring 100 is pivotally attached to both the housing 104 and to the trigger lever 106.

Preferred embodiments of this invention have been disclosed, however, a worker of ordinary skill in this art would recognize that certain modifications would come within the scope of this invention. For that reason, the following claims should be studied to determine the true scope and content of this invention.

The invention claimed is:

1. A stapler comprising:

a handle extending upwardly above a housing and pivotally attached within said housing at a handle pivot point;

a pair of links each attached to a single roller, with a first of said links being pivotally attached to said handle and a second of said links being pivotally attached to said housing;

a trigger lever having a slot receiving said single roller, said trigger lever being pivotally attached to said housing at a trigger pivot point, and a trigger portion pivoting with said trigger lever; and said housing further including a plunger and a power spring for driving said plunger to drive a staple into a workpiece, said trigger portion being operable to lift said plunger against the force of said power spring as said handle is pivoted downwardly toward said housing about said handle pivot point, with said pair of links causing said trigger lever to pivot about said trigger pivot point and causing said trigger portion to lift said plunger.

2. A stapler as recited in claim 1, wherein said pivotal attachment of each of said first and second links being at first and second link pivot points on opposed sides of said handle pivot point.

3. A stapler as recited in claim 2, wherein said first link pivot point is at a forward side of said handle pivot point toward said plunger and said second link pivot point is on a rear side of said handle pivot point spaced away from said plunger.

4. A stapler as recited in claim 3, wherein said single roller is spaced toward said plunger relative to a position of said first link pivot point.

5. A stapler as set forth in claim 1, wherein said trigger portion is received under a ledge portion of said plunger.

6. A stapler as set forth in claim 5, wherein said trigger portion is received on pins in a portion of said trigger lever, and said pins being spring biased to bias said trigger portion toward said plunger.

7. A stapler as set forth in claim 6, wherein said trigger portion receives a first pin and said trigger lever receives a second pin, said first pin being movable within a slot on said trigger lever and said second pin being movable within a slot on said trigger portion, a spring biasing said first pin toward said second pin to bias said trigger portion toward said plunger.

8. A stapler as set forth in claim 7, wherein a lower face of said trigger portion and an upper end of said plunger ledge are ramped to facilitate return movement of said trigger portion beyond said ledge.

9. A stapler comprising:

a handle to be pivoted relative to a stapler body to cause a trigger lever to pivot about a pivot point downwardly, said pivot point being adjacent a rear end of said stapler body, and said downward movement of said handle being toward a plunger at an opposite forward end of said stapler body and said downward movement of said handle causing upward movement of said plunger;

said plunger being driven by a power spring to return downwardly and fire a stapler;

said trigger lever including a trigger portion, said trigger portion being rectilinearly movable forwardly and rearwardly relative to said trigger lever and biased towards a forward position by a spring force, said trigger portion being received under a ledge on said plunger to lift said plunger as said trigger lever moves.

10. A stapler as set forth in claim 9, wherein said trigger portion is received on pins in a portion of said trigger lever, and said pins being spring biased to bias said trigger portion toward said plunger.

11. A stapler as set forth in claim 9, wherein a lower face of said trigger portion and an upper end of said plunger ledge are ramped to facilitate return movement of said trigger portion beyond said ledge.

12. A stapler comprising:

a handle to be pivoted relative to a stapler body to cause a trigger lever to pivot and cause upward movement of a plunger;

said plunger being driven by a power spring to return downwardly and fire a stapler;

said trigger lever including a trigger portion, said trigger portion being movable forwardly and rearwardly relative to said trigger lever and biased towards a forward position by a spring force, said trigger portion being received under a ledge on said plunger to lift said plunger as said trigger lever moves;

said trigger portion is received on pins in a portion of said trigger lever, and said pins being spring biased to bias said trigger portion toward said plunger; and said trigger portion receives a first pin and said trigger lever receives a second pin, said first pin being movable within a slot on said trigger lever and said second pin being movable within a slot on said trigger portion, a spring biasing said first pin toward said second pin to bias said trigger portion toward said plunger.

13. A stapler comprising:

a handle extending upwardly above a housing and pivotally attached within said housing at a handle pivot point;

a pair of links each attached to a single roller, with one of said links being pivotally attached to said handle at a first link pivot point and a second of said links being pivotally attached to said housing at a second link pivot point, said first and second link pivot points being on opposed sides of said handle pivot point;

a trigger lever having a slot receiving said single roller, said single roller being spaced towards a plunger relative to a position of said first and second link pivot points, and said handle pivot point, said trigger lever being pivotally attached to said housing at a trigger pivot point, and said trigger lever carrying a trigger portion;

said plunger having a power spring for driving said plunger to drive a staple into a workpiece, said trigger portion being operable to lift said plunger against the force of said power spring as said handle is pivoted downwardly toward said housing about said handle pivot point, with said pair of links causing said trigger lever to pivot about said trigger pivot point to cause said trigger portion to lift said plunger, said trigger portion being movable forwardly and rearwardly relative to said trigger lever and biased towards a forward position by a spring force, said trigger portion being received under a ledge of said plunger to lift said plunger as said trigger lever moves, and said trigger portion being operable to move away from said plunger and allow said plunger to be driven by said power spring.

14. A stapler as set forth in claim 13, wherein said trigger portion receives a first pin and said trigger lever receives a second pin, said first pin being movable within a slot on said trigger lever and said second pin being movable within a slot on said trigger portion, a spring biasing said first pin toward said second pin to bias said trigger portion toward said plunger.

* * * * *